US010020155B2

(12) United States Patent
Grumel et al.

(10) Patent No.: US 10,020,155 B2
(45) Date of Patent: Jul. 10, 2018

(54) ELECTRICAL SWITCHING APPARATUS COMPRISING A SWITCHING MECHANISM AND AT LEAST ONE AUXILIARY MODULE

(71) Applicant: Schneider Electric Industries SAS, Rueil-Malmaison (FR)

(72) Inventors: Christophe Grumel, Lans en Vercors (FR); Alain Brouillat, La Valette (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/286,743

(22) Filed: Oct. 6, 2016

(65) Prior Publication Data

US 2017/0110278 A1 Apr. 20, 2017

(30) Foreign Application Priority Data

Oct. 20, 2015 (FR) ..... 15 60009

(51) Int. Cl.
*H01H 71/10* (2006.01)
*H01H 71/74* (2006.01)
(Continued)

(52) U.S. Cl.
CPC ..... *H01H 71/7409* (2013.01); *H01H 1/2058* (2013.01); *H01H 71/02* (2013.01);
(Continued)

(58) Field of Classification Search
CPC ..... H01H 71/7409; H01H 71/1009; H01H 71/0228; H01H 71/1045
(Continued)

(56) References Cited

U.S. PATENT DOCUMENTS 5,440,088 A 8/1995 Coudert et al.
6,480,082 B1 11/2002 Aihara et al.
(Continued)

FOREIGN PATENT DOCUMENTS

EP 0 591 074 B1 3/1997
FR 3 016 471 A1 7/2015
JP 5-11284 U 2/1993

OTHER PUBLICATIONS

French Preliminary Search Report dated Jul. 6, 2016 in French Application 15 60009, filed on Oct. 20, 2015 ( with English Translation of Categories of Cited Documents).

*Primary Examiner* — Vanessa Girardi
(74) *Attorney, Agent, or Firm* — Oblon, McClelland, Maier & Neustadt, L.L.P.

(57) ABSTRACT

This electrical switching apparatus includes a protection casing, at least one switching member suitable for switching between a first position permitting the passage of a current and a second position preventing the passage of the current, a mechanism for control of the or of each switching member, and at least one auxiliary module disposed in the casing, the auxiliary module being removable with respect to the casing and configured to implement a function associated with the control mechanism. The electrical switching apparatus includes a mechanical referencing member common to the control mechanism and to each auxiliary module, for the positioning of the control mechanism and of each auxiliary module in the casing.

12 Claims, 5 Drawing Sheets

Figure 1:
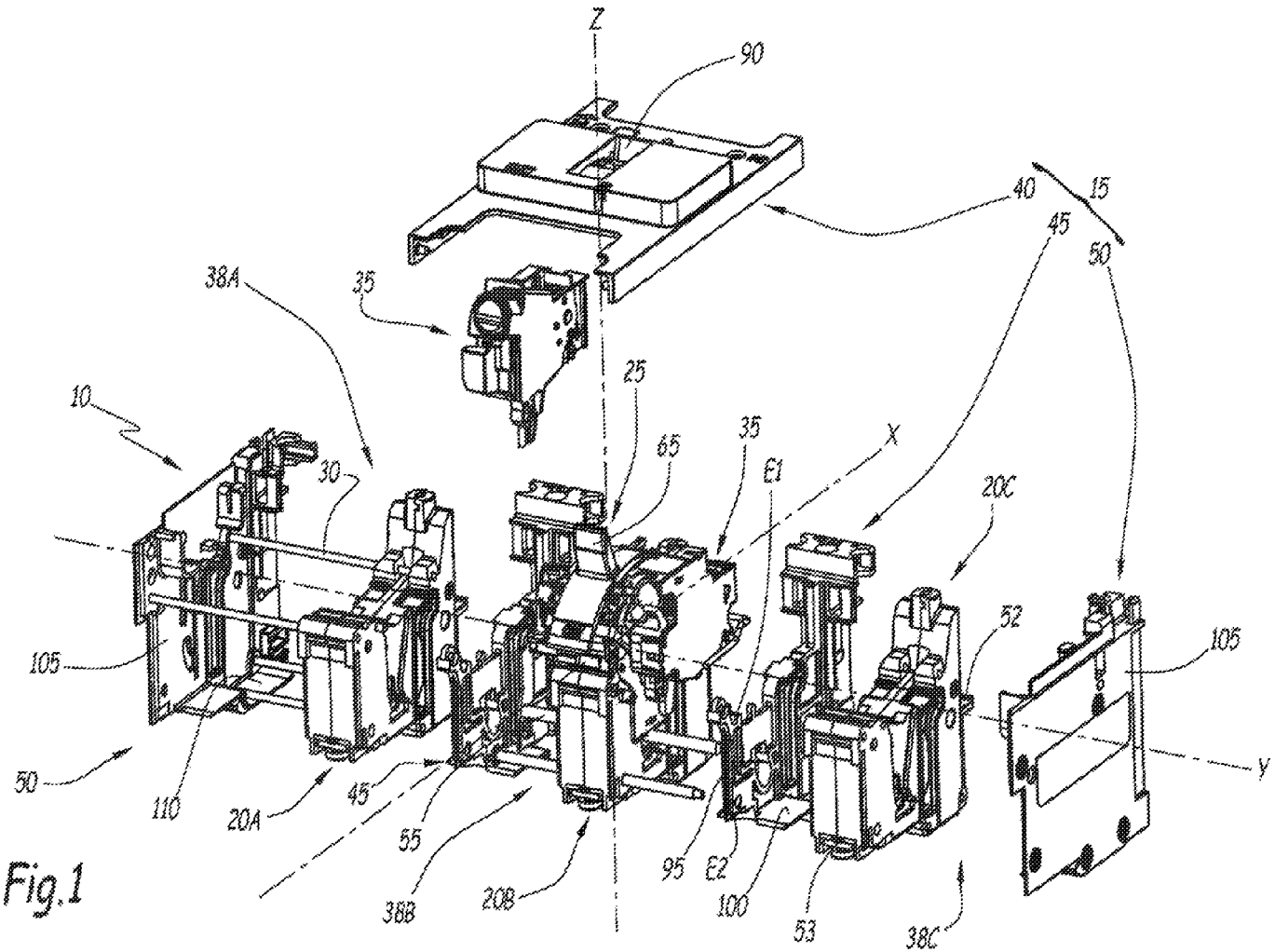

(51) Int. Cl.

| | |
|---|---|
| ***H01H 71/02*** | (2006.01) |
| ***H01H 71/12*** | (2006.01) |
| ***H01H 1/20*** | (2006.01) |
| *H01H 83/20* | (2006.01) |

(52) U.S. Cl.
CPC .... *H01H 71/0214* (2013.01); *H01H 71/0228* (2013.01); *H01H 71/0235* (2013.01); *H01H 71/1009* (2013.01); *H01H 71/12* (2013.01); *H01H 71/1045* (2013.01); *H01H 83/20* (2013.01); *H01H 2071/0242* (2013.01)

(58) Field of Classification Search
USPC ..... 200/293, 400; 335/6, 9, 172
See application file for complete search history.

(56) References Cited

U.S. PATENT DOCUMENTS

| | | | | |
|---|---|---|---|---|
| 6,747,535 | B2 * | 6/2004 | Castonguay ..... | H01H 71/1009 200/330 |
| 2003/0071702 | A1 | 4/2003 | Castonguay et al. | |

* cited by examiner

ELECTRICAL SWITCHING APPARATUS COMPRISING A SWITCHING MECHANISM AND AT LEAST ONE AUXILIARY MODULE

The present invention relates to an electrical switching apparatus comprising a protection casing, at least one switching member, a control mechanism for the switching member and at least one auxiliary module.

The switching apparatuses such as circuit breakers, often comprise one or more switching members, which are configured to transmit a current between two connection lugs and, when necessary, to cut the current, then isolating the connection lugs from one another. When such a switching device is used for a multiphase electricity distribution network, the switching device generally comprises a switching member for each phase. In this configuration, the switching members are, generally, controlled by a common control mechanism, separate from the switching members. Such a configuration makes it possible, among other things, to ensure that the currents of the different phases are indeed interrupted in the event of detection of a malfunction on any one of the phases.

A circuit breaker is known from the document EP 0 591 074 A1 that comprises a moulded casing comprising several housings capable of each receiving an auxiliary module. The auxiliary modules have functions such as, for example, signaling the state of the circuit breaker to a remote operator, or even tripping the control mechanism. When the function of the auxiliary module requires a mechanical action of the auxiliary module on another element of the circuit breaker, such as the control mechanism, it is then necessary to accurately position the auxiliary module in the casing, for the function to be best fulfilled.

In the case of the document EP 0 591 074 A1, the housings receiving the auxiliary modules are formed in the cover of the moulded casing. In other configurations, the auxiliary modules are received in cradles that is to say jackets especially provided and disposed in the casing.

However, such techniques for positioning the auxiliary modules in the casing are not optimal because an excessive dimensional dispersion may remain between the different parts of the apparatus.

The aim of the invention is therefore to propose a switching apparatus comprising at least one auxiliary module, which is more reliable.

To this end, the subject of the invention is an electrical switching apparatus comprising:

- a protection casing,
- at least one switching member disposed in the casing and comprising an input connection lug and an output connection lug, the switching member being suitable for switching between a first position permitting the passage of the current between the input connection lug and the output connection lug and a second position preventing the passage of the current between the input connection lug and the output connection lug,
- a mechanism for control of the or of each switching member between its first and second positions, and
- at least one auxiliary module disposed in the casing, the auxiliary module being removable with respect to the casing and configured to implement an electrical or mechanical function associated with the control mechanism.

The electrical switching apparatus further comprises a mechanical referencing member common to the control mechanism and to each auxiliary module, for the positioning of the control mechanism and of each auxiliary module in the casing.

According to other advantageous aspects of the invention, the switching apparatus comprises one or more of the following characteristics, taken in isolation or in all technically possible combinations:

- the auxiliary module and the mechanical referencing member are mechanically linked by a mechanical link eliminating four degrees of freedom between the auxiliary module and the mechanical referencing member;
- the switching apparatus comprises a plurality of switching members aligned in a transverse direction of the switching apparatus and a plurality of spacers, each spacer separating two respective switching members in the transverse direction, the auxiliary module being mechanically coupled to a spacer;
- the auxiliary module and the spacer are mechanically linked by a mechanical link eliminating a degree of freedom between the auxiliary module and the spacer;
- the auxiliary module is directly mechanically coupled to the control mechanism;
- the auxiliary module and the control mechanism are mechanically linked by a mechanical link eliminating a degree of freedom between the auxiliary module and the control mechanism;
- the switching apparatus further comprises a guiding member configured to guide the auxiliary module relative to the casing upon the insertion of the auxiliary module into the casing or upon the extraction of the auxiliary module from the casing;
- the switching apparatus comprises a plurality of auxiliary modules, each auxiliary module being disposed in the casing, the mechanical referencing member being common to the control mechanism and to each auxiliary module for the positioning of the control mechanism and of the auxiliary modules in the casing;
- the auxiliary module comprises an elastic retaining protuberance configured to prevent a manual removal of the auxiliary module from the casing;
- the mechanical referencing member is common to each auxiliary module, to the control mechanism and to each switching member;
- the auxiliary module is a trip configured to actuate the control mechanism for the switching of the switching member;
- the switching apparatus is a circuit breaker.

Figure 2:
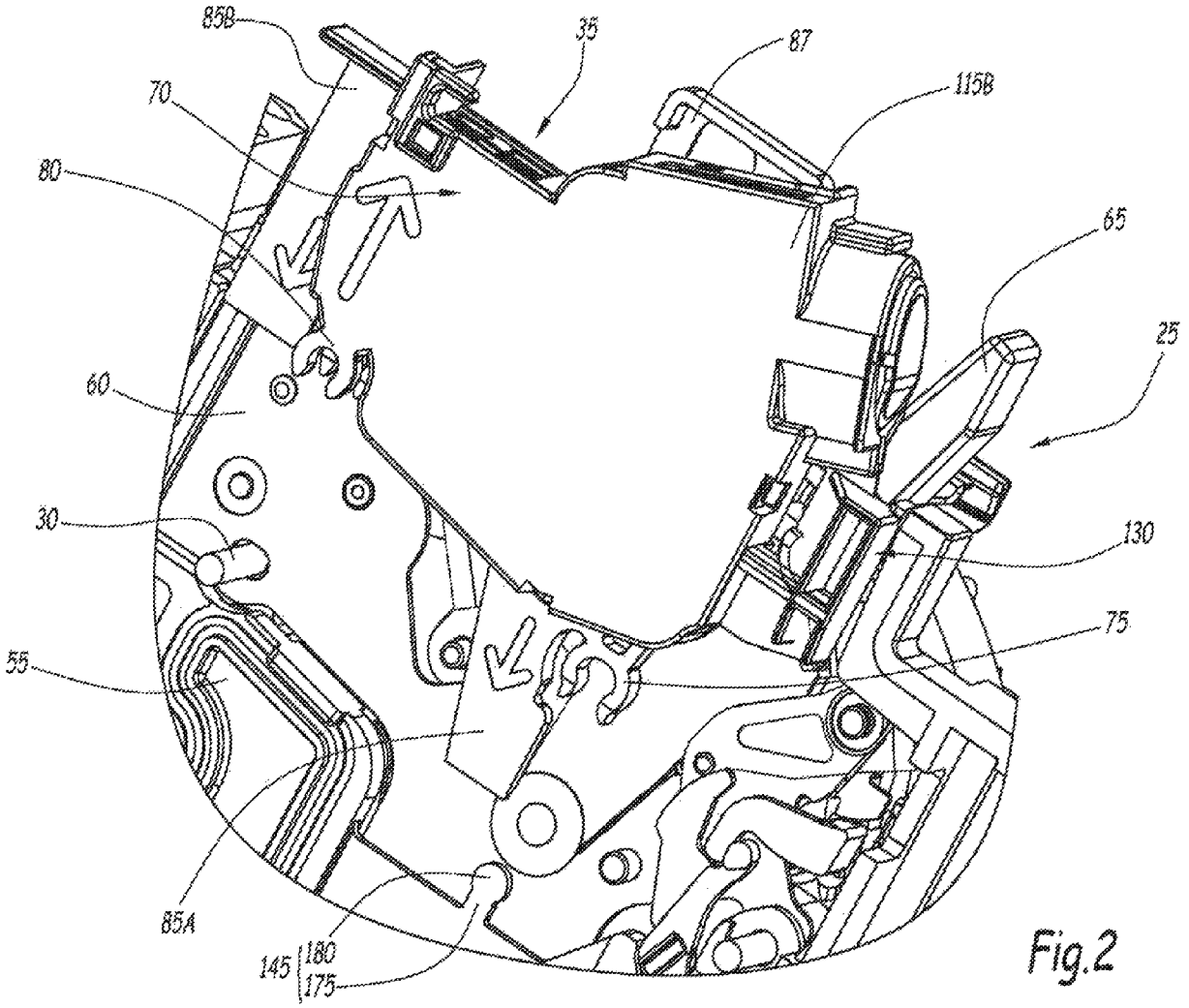
Figure 3:
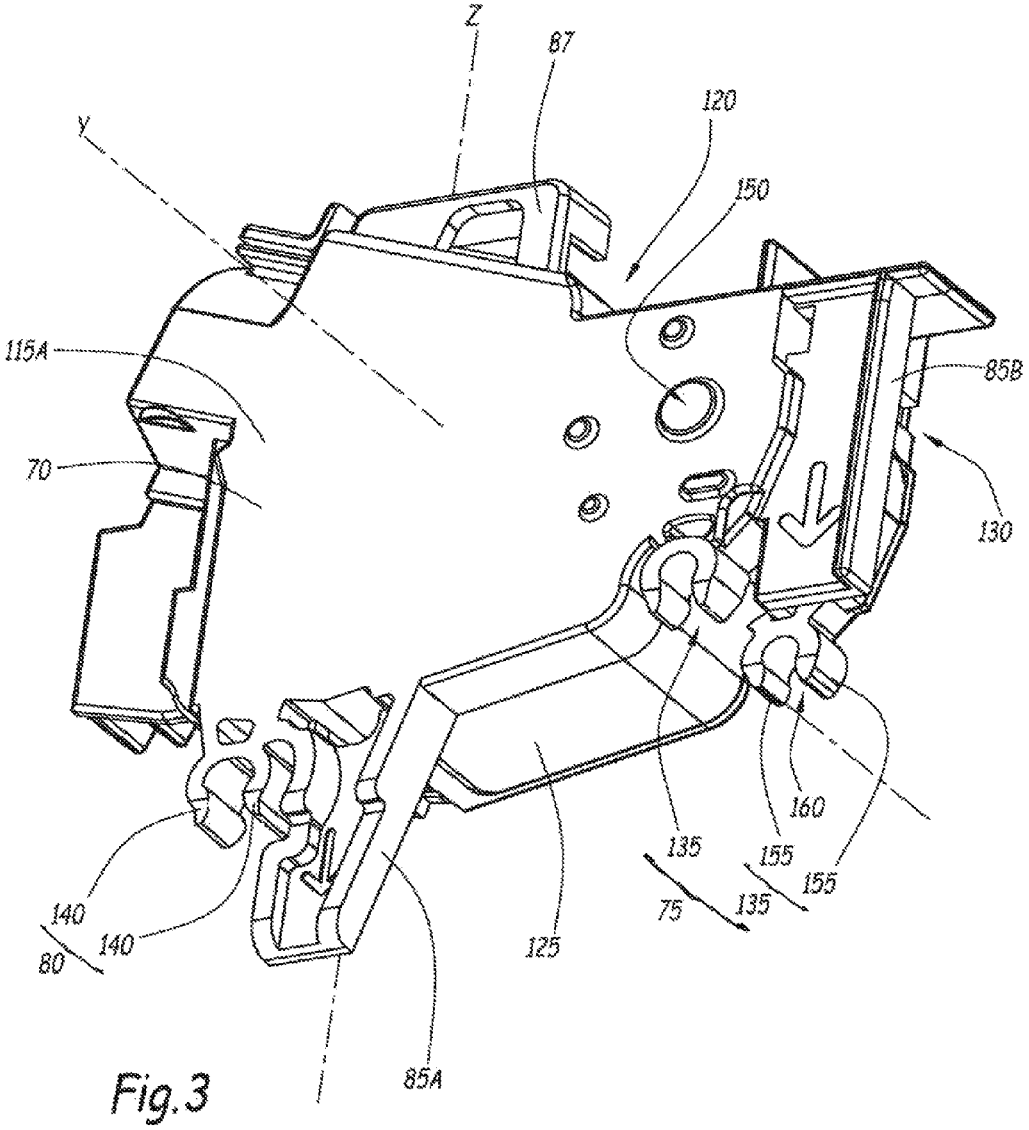
Figure 4:
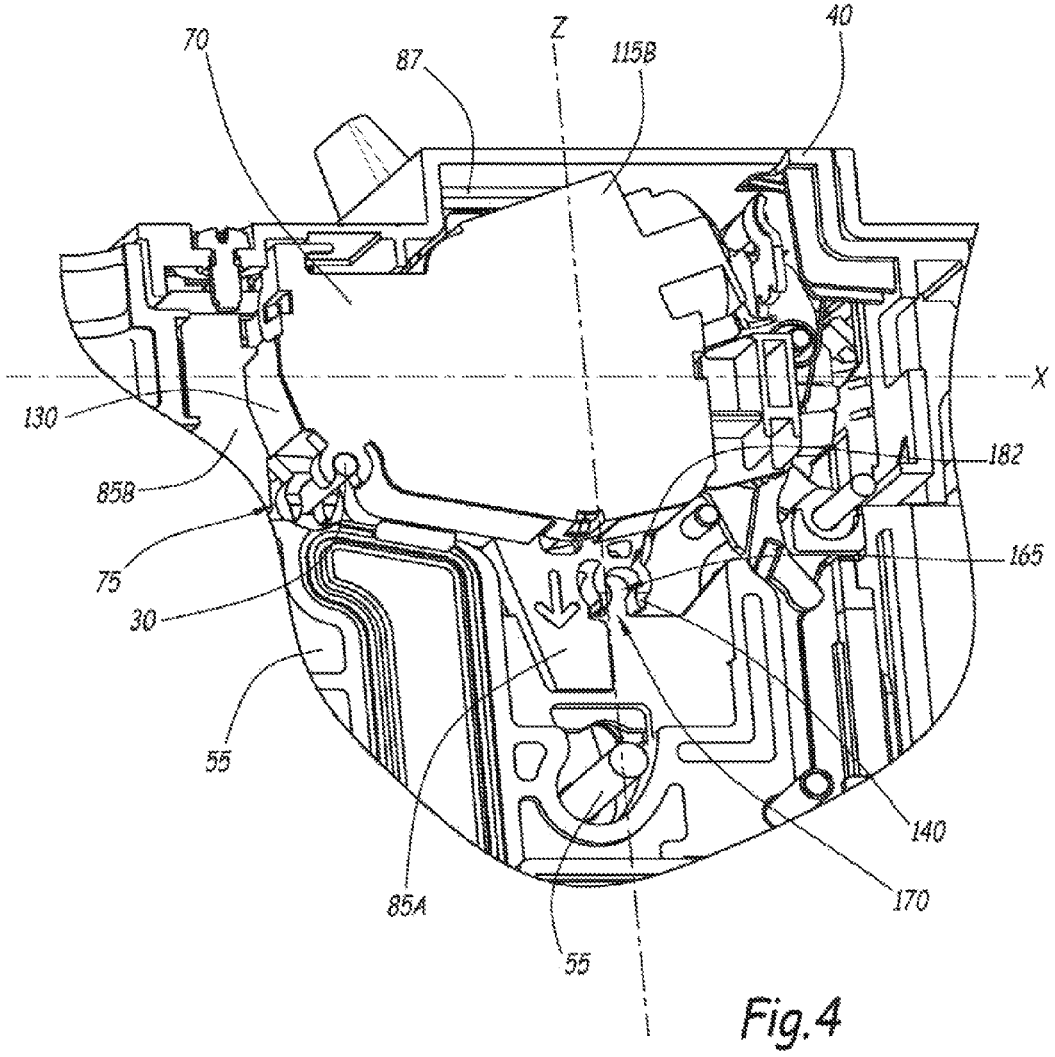
Figure 5:
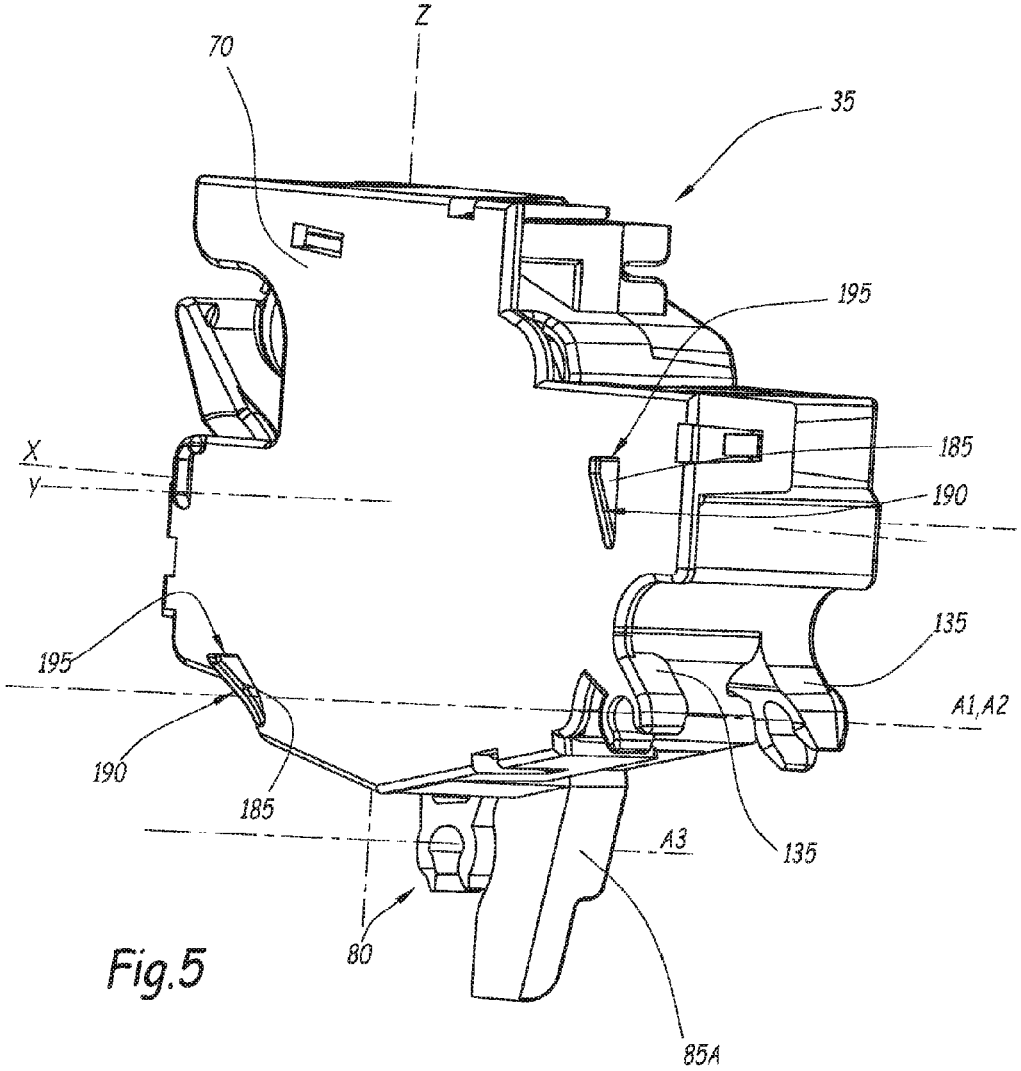

These features and advantages of the invention will become apparent on reading the following description, given purely as a non-limiting example, and with reference to the attached drawings, in which:

FIG. 1 is an exploded view of a switching apparatus comprising an auxiliary module and a casing with spacers, FIG. 2 is a cross-sectional view from the side of the switching apparatus of FIG. 1, in which the auxiliary module is partially extracted from the casing and is not mechanically coupled to the spacer, FIG. 3 is a perspective view of the auxiliary module of FIG. 1, FIG. 4 is a cross-sectional view from the side of the switching apparatus of FIG. 1, in which the auxiliary module is disposed in the casing and mechanically coupled to the spacer, and FIG. 5 is a perspective view of another auxiliary module.

An electrical switching apparatus 10 comprises a casing 15, a first switching member 20A, a second switching member 20B, a third switching member 20C, a control mechanism 25 for each switching member 20A, 20B, 20C, a mechanical referencing member 30 and at least one auxiliary module 35.

The switching apparatus 10 is suitable for receiving, via an input electrical conductor, a first electrical current and to deliver the first electrical current to an output electrical conductor, and vice versa.

Preferably, the switching apparatus 10 is suitable for receiving several first electrical currents, via a plurality of input conductors, and to deliver each first electrical current to a respective output conductor. In FIG. 1, the switching apparatus 10 is a three-phase circuit breaker.

For the switching apparatus 10, there are defined a vertical direction Z, a transverse direction Y and a longitudinal direction X. The vertical direction Z, the transverse direction Y and the longitudinal direction X are each at right angles to the other two.

The casing 15 is suitable for at least partially insulating each switching member 20A, 20B, 20C, the control mechanism 25 and each auxiliary module 35 from the outside of the casing 15.

The casing 15 delimits a first chamber 38A for receiving the first switching member 20A, a second chamber 38B for receiving the second switching member 20B and a third chamber 38C for receiving the third switching member 20C.

The casing 15 is made of an electrically insulating material. For example, the casing 15 is made of a plastic material.

In FIG. 1, the casing 15 is partially in the form of a rectangular parallelepiped. The casing 15 comprises a cover 40, two spacers 45 and two lateral plates 50.

Each switching member 20A, 20B, 20C comprises an input connection lug 52 and an output connection lug 53. Each switching member 20A, 20B, 20C is disposed in the casing 15. Preferably, each switching member 20A, 20B, 20C is disposed in a reception chamber 38A, 38B, 38C of the casing 15. Each switching member 20A, 20B, 20C is separated from another switching member 20A, 20B, 20C, in the transverse direction Y by a corresponding spacer 45.

Each switching member 20A, 20B, 20C is suitable for switching between a first position permitting the passage of the first current between the input connection lug 52 and the output connection lug 53, and a second position preventing the passage of the first current between the input connection lug 52 and the output connection lug 53. The switching member 20A, 20B, 20C is, for example, a double cut-off rotary switching member or even another type of switching member known to those skilled in the art.

Each switching member 20A, 20B, 20C is suitable for receiving, on the input connection lug 52, the first current. The switching member 20A, 20B, 20C is suitable, in its first position, for delivering the first current to the output connectioning 53.

The control mechanism 25 is configured to displace each switching member 20A, 20B, 20C between its first position and its second position. In particular, the control mechanism 25 is suitable for controlling cutting, by each switching member 20A, 20B, 20C, of the first current between the input connection lug 52 and the output connection lug 53.

For example, the control mechanism 25 comprises a control shaft 55 passing through the control mechanism 25 and each switching member 20A, 20B, 20C. The control mechanism 25 is suitable for displacing the control shaft 55 between a primary position in which each switching member 20A, 20B, 20C is in its first position and a secondary position in which each switching member 20A, 20B, 20C is in its second position.

The control mechanism 25 has two lateral shrouds 60 and a crank pin 65, also called control lever. The control mechanism 25 is disposed in the casing 15.

In the example of FIG. 1, the control mechanism 25 is disposed in the casing 15 in such a way that one of the switching members 20A, 20B, 20C is received between the two shrouds 60.

The mechanical referencing member 30 is, according to the invention, suitable for allowing the positioning, in the casing 15 both of the control mechanism 25 and of each auxiliary module 35. The mechanical referencing member 30 is common to the control mechanism 25 and to each auxiliary module 35 for the positioning of the control mechanism 25 and of the auxiliary module or modules 35 in the casing 15. More specifically, the mechanical referencing member 30 keeps each auxiliary module 35 in position relative to the control mechanism 25.

Preferably, the mechanical referencing member 30 is common to each auxiliary module 35, to the control mechanism 25 and to each switching member 20A, 20B, 20C.

The mechanical referencing member 30 is mechanically coupled to the control mechanism 25 and to each auxiliary module 35. For example, the mechanical referencing member 30 passes through the two shrouds 60 of the control mechanism 25.

The mechanical referencing member 30 is, for example, in the form of a cylindrical bar with circular base around a first axis A1 parallel to the transverse direction Y.

In the example of FIG. 1, the mechanical referencing member 30 passes in succession, in the transverse direction Y, through a corresponding lateral plate 50, the first switching member 20A, a corresponding shroud 60, the second switching member 20B, the other shroud 60, the third switching member 20C, and the other lateral plate 50.

The mechanical referencing member 30 has a first diameter D1 of between 2 millimeters (mm) and 10 mm. For example, the first diameter D1 is between 2 mm and 4 mm.

Each auxiliary module 35 is removable with respect to the casing 15. The auxiliary module 35 is designed to be removed from the casing 15 by an operator, to an extracted position in which the auxiliary module 35 is no longer suitable for implementing its function in relation to the control mechanism 25. For example, the auxiliary module 35 is removable, with respect to the casing, by a translation in the vertical direction Z.

Each auxiliary module 35 is mechanically coupled to the mechanical referencing member 30. In other words, each auxiliary module 35 and the mechanical referencing member 30 are mechanically linked by a mechanical link.

Preferably, the mechanical link between the mechanical referencing member 30 and the corresponding auxiliary module 35 is a mechanical link eliminating four degrees of freedom between the auxiliary module 35 and the mechanical referencing member 30. The mechanical link between the mechanical referencing member 30 and the auxiliary module 35 therefore allows two degrees of freedom between the auxiliary module 35 and the mechanical referencing member 30.

For example, the corresponding auxiliary module 35 and the mechanical referencing member 30 are mechanically linked by a mechanical link of "sliding pivot" type about the transverse direction Y. The mechanical link between the auxiliary module 35 and the mechanical referencing member 30 permits a respective movement, between the auxiliary module 35 and the mechanical referencing member 30, in rotation about the transverse direction Y, or translational in the transverse direction Y.

Each auxiliary module 35 is mechanically coupled to a corresponding spacer 45. Preferably, the auxiliary module 35 and the spacer are mechanically linked by a mechanical link eliminating a degree of freedom between the auxiliary module 35 and the spacer 45. For example, the auxiliary module 35 and the spacer are mechanically linked by a mechanical link of "spot link" type. Preferably, the mechanical link between the auxiliary module 35 and the spacer 45 prevents a respective rotational movement, between the auxiliary module 35 and the mechanical referencing member 30, about the transverse direction Y. The mechanical link between the auxiliary module 35 and the spacer 45 therefore allows five degrees of freedom between the auxiliary module 35 and the spacer 45.

Each auxiliary module 35 is, furthermore, directly mechanically coupled to the control mechanism 25. For example, the enclosure 70 of the auxiliary module 35 is in contact with a corresponding shroud 60 of the control mechanism 25. Preferably, the auxiliary module 35 and the control mechanism 25 are mechanically linked by a mechanical link eliminating a degree of freedom between the auxiliary module 35 and the control mechanism 25. For example, the mechanical link between the auxiliary module 35 and the control mechanism 25 is a link of "spot link" type. Preferably, the mechanical link between the auxiliary module 35 and the control mechanism 25 prevents a respective translational movement in the transverse direction Y.

The mechanical link between the auxiliary module 35 and the control mechanism 25 therefore allows five degrees of freedom between the auxiliary module 35 and the control mechanism 25. Each auxiliary module 35 comprises an enclosure 70, a trip mechanism, not represented, a first mechanical coupling member 75, a second mechanical coupling member 80, at least one guiding member 85A, 85B and a bearing member 87, visible in FIG. 2. According to the example of FIG. 2, the auxiliary module 35 comprises a first guiding member 85A and a second guiding member 85B.

Each auxiliary module 35 has a length measured in the longitudinal direction X, a width measured in the transverse direction Y, and an overall height measured in the vertical direction Z. The length of the auxiliary module 35 is, for example, equal to 60 mm. The width of the auxiliary module 35 is, for example, equal to 15 mm. The height of the auxiliary module 35 is, for example equal to 55 mm.

Each auxiliary module 35 is configured to implement a mechanical function associated with the control mechanism 25.

For example, the auxiliary module 35 is a trip configured to actuate the control mechanism for the switching of each switching member 20A, 20B, 20C. The auxiliary module 35 is then suitable for displacing, via the control mechanism 25, each switching member 20A, 20B, 20C from its first position to its second position.

The auxiliary module 35 is then, preferably, a volt meter-based trip. The auxiliary module 35 is then configured to measure at least one quantity relating to the first current, and to actuate the control mechanism 25 when the measured quantity is situated outside of a predefined range of values.

According to another example, the auxiliary module 35 is a trip of de-energize-to-trip type, that is to say that the auxiliary module 35 is configured to actuate the control mechanism 25 when the voltage corresponding to the first current is lower than a first predefined value. As a variant, the auxiliary module 35 is a trip of energize-to-trip type. This means that the auxiliary module 35 is configured to actuate the control mechanism 25 when the measured voltage is higher than a second predefined value.

As a variant, the auxiliary module 35 is an electronic trip suitable for detecting an electrical fault on the first current and for actuating the control mechanism 25 if the electrical fault is detected. The electrical fault is, for example, a short-circuit current, an overload current or even an insulation fault.

Again as a variant, the auxiliary module 35 is a signaling module suitable for communicating a trip signal to a remote electronic device when the control mechanism 25 is actuated, for example by another auxiliary module 35, to interrupt the first current.

Each reception chamber 38A, 38B, 38C is configured to allow a switching member 25 to be disposed in the reception chamber 38A, 38B, 38C. Each spacer 45 then separates, in the transverse direction Y, two respective switching members 20A, 20B, 20C.

The reception chambers 38A, 38B, 38C are aligned in the transverse direction Y. The orthogonal projections of each reception chamber 38A, 38B, 38C in the transverse direction Y are superposed. In other words, each reception chamber 38A, 38B, 38C can be superposed with each other reception chamber 38A, 38B, 38C by a translation in the transverse direction Y.

The cover 40 is mobile, relative to the lateral plates 50, between an open position in which each switching member 20A, 20B, 20C, the control mechanism 25 and each auxiliary module 35 are accessible to an operator and a closed position in which each switching member 20A, 20B, 20C, the control mechanism 25 and each auxiliary module 35 are at least partially isolated from the outside of the casing 15.

When the cover 40 is in the closed position, the cover 40 is overall at right angles to the vertical direction Z of the switching apparatus 10. The cover 40 is rectangular.

The cover 40 has an access opening 90 allowing access to the crank pin 65 when the cover 40 is in the closed position.

Each spacer 45 is configured to partially delimit at least one reception chamber 38A, 38B, 38C. Each spacer 45 comprises a main wall 95 and a secondary wall 100.

Each lateral plate 50 comprises a lateral wall 105 and a bottom wall 110.

The two spacers 45 and the two lateral plates 50 are substantially aligned in the transverse direction Y of the switching apparatus 10.

Each connection lug 52, 53 is suitable for being electrically connected to an input conductor or an output electrical conductor. Each connection lug 52, 53 is, for example, produced in the form of a parallelepipedal tongue extending at right angles to the vertical direction Z.

Each shroud 60 is flat. Each shroud 60 is at right angles to the transverse direction Y. The switching mechanism 25 is delimited, in the transverse direction Y, by the two shrouds 60.

The crank pin 65 is configured to allow an operator to displace, via the control mechanism 25, each switching member 20A, 20B, 20C between its first position and its second position. For example, the crank pin 65 is accessible from the outside of the casing 15 via the opening 90 formed in the cover 40 when the cover 40 is in the closed position.

Each enclosure 70 is configured to isolate the trip mechanism from the outside of the enclosure 70. For example, the enclosure 70 is made of a plastic material.

Each enclosure 70 has a first lateral face 115A, a second lateral face 115B, a top face 120, a bottom face 125 and two end faces 130.

Each first mechanical coupling member 75 is configured to mechanically couple a respective auxiliary module 35 and the mechanical referencing member 30. In the example of FIG. 3, each first mechanical coupling member 75 is configured to mechanically couple the respective auxiliary module 35 and the mechanical referencing member 30 by snap-fitting.

The first mechanical coupling member 75 is configured to form a link with two degrees of freedom between the mechanical referencing member 30 and the auxiliary module 35. The mechanical link between the mechanical referencing member 30 and the auxiliary module 35 therefore eliminates four degrees of freedom between the mechanical referencing member 30 and the auxiliary module 35.

Each first mechanical coupling member 75 comprises two elastic coupling elements 135.

Each second mechanical coupling member 80 is configured to mechanically couple the auxiliary module 35 and the spacer 45. In the example of FIG. 4, the second mechanical coupling member 80 is configured to mechanically couple the auxiliary module 35 and the spacer 45 by snap-fitting.

Each second mechanical coupling member 80 is configured to form a link with five degrees of freedom between the spacer 45 and the auxiliary module 35. The mechanical link formed by each second mechanical coupling member therefore eliminates one degree of freedom between the auxiliary module 35 and the spacer 45.

Each second mechanical coupling member 80 is borne by the bottom face 125. The second mechanical coupling member 80 comprises two elastic arms 140.

Each guiding member 85A, 85B is configured to guide the auxiliary module 35 relative to the casing 15, upon a displacement of the auxiliary module 35 relative to the casing 15.

Each guiding member 85A, 85B is formed integrally with the enclosure 70.

The first guiding member 85A is borne by the bottom face 125. The first guiding member 85A is in the form of a tap extending from the bottom face 125 in the vertical direction Z. The first guiding member 85A is configured to collaborate with a bearing surface of the casing 15 to guide the auxiliary module 35 relative to the casing 15.

The second guiding member 85A is borne by an end face 130. The second guiding member 85B is in the form of a flat tongue at right angles to the longitudinal direction X. The second guiding member 85B is configured to be inserted into a complementary slit, not represented, of the casing 15.

The bearing member 87 is borne by the top face 120 of the enclosure 70. The bearing member 87 is configured so that, when the cover 40 is displaced from the open position to the closed position, and the auxiliary module 35 is partially inserted into the casing 15, the cover 40 exerts on the bearing member 87 a displacement force tending to displace the auxiliary module 35, in the vertical direction Z, towards the interior of the casing 15.

The expression "partially inserted" should be understood to mean that the auxiliary module 35 is partly received in the casing 15 but is not mechanically coupled to the mechanical referencing member 30.

The bearing member 87 is, for example, in the form of a protuberance having a flat surface intended to be in contact with the cover 40 when the cover is in the closed position and the auxiliary module 35 is partially inserted into the casing 15.

The main wall 95 is planar. The main wall 95 is at right angles to the transverse direction Y.

Each main wall 95 has a first end E1 and a second end E2. The first end E1 and the second end E2 are opposite one another in the vertical direction Z. The second end E2 is opposite the cover 40 when the cover 40 is in the closed position. The first end E1 comprises a catch 145, visible in FIG. 2.

The secondary wall 100 is at right angles to the vertical direction Z. The main wall 95 and the secondary wall 100 are formed integrally with one another. The secondary wall 100 delimits the main wall 95 in the vertical direction Z. The secondary wall 100 is disposed at the second end E2 of the main wall 95.

The lateral wall 105 is flat. The lateral wall 105 is at right angles to the transverse direction Y. The bottom wall 110 is at right angles to the vertical direction Z. The lateral wall 105 and the bottom wall 110 are formed integrally with one another. The bottom wall 110 delimits the lateral wall 105 in the vertical direction Z. The bottom wall 110 is disposed at one end of the lateral wall 105 opposite the cover 40 when the cover 40 is in the closed position.

The secondary wall 100 of each spacer 45 is delimited, in the transverse direction Y, by the bottom wall 110 of a lateral plate 50 and by the secondary wall 100 of the other spacer 45. A part passing through the casing 15 in the transverse direction Y then passes in succession through a corresponding lateral plate 50, the two spacers 45, then the other lateral plate 50.

The first reception chamber 38A and the third reception chamber 38C are delimited, in the transverse direction Y, by a corresponding main wall 95 and by a corresponding lateral plate 50, while the second reception chamber 38B is delimited, in the transverse direction Y, by the two main walls 95.

The secondary walls 100 and the bottom walls 110 are configured to collaborate with one another to form a bottom of the casing 15. The bottom of the casing 15 is suitable for isolating the switching members 25 from the outside of the casing in the vertical direction Z.

The lateral faces 115A, 115B are opposite in the transverse direction Y. The lateral faces 115A, 115B delimit the enclosure 70 in the transverse direction Y. Each lateral face 115A, 115B is flat. Each lateral face 115A, 115B is at right angles to the transverse direction Y.

Preferably, the first lateral face 115A bears against the control mechanism 25. For example, the first lateral face 115A has a protuberance 150 configured to come to bear against a corresponding shroud 60 of the control mechanism 25.

The top face 120 and the bottom face 125 are opposite in the vertical direction Z. The bottom face 125 is defined as being the face turned towards the bottom of the casing 15.

The end faces 130 are opposite in the longitudinal direction X. The end faces 130 delimit the enclosure 70 in the longitudinal direction X.

The trip mechanism is disposed in the enclosure 70. The trip mechanism is suitable for actuating the control mechanism 25 for the switching of each switching member 20A, 20B, 20C. The trip mechanism is known per se.

Each elastic coupling element 135 is designed to collaborate with the mechanical referencing member 30 by snap-fitting. The elastic coupling elements 135 are aligned in the transverse direction Y.

Each elastic coupling element 135 is borne by the bottom face 125.

Each elastic element 135 comprises two elastic branches 155 delimiting a first cavity 160 for receiving the mechanical referencing member 30.

The elastic arms 140 delimit a second cavity 165 for receiving the tenon 145 and a second opening 170 for introduction of the tenon 145 into the second reception cavity 145. Each elastic arm 140 is integrally formed with the enclosure 70.

Each elastic arm 140 has a width, measured in the transverse direction Y, less than or equal to 6 mm. Because of their flexibility and their small width, the elastic arms 140 do not therefore prevent the rotation, about the longitudinal direction X or the vertical direction Z, between the auxiliary module 35 and the spacer 45.

The tenon 145 is integrally formed with the main wall 95. The tenon 145 has a cylindrical form with circular base about the transverse direction Y. For example, the tenon 145 has a parallelepipedal base 175 and a cylindrical head 180 with circular base about an axis parallel to the transverse direction Y.

The protuberance 150 is, for example, cylindrical with circular base about the transverse direction Y. The protuberance 150 has a second diameter D2, measured in a plane at right angles to the transverse direction Y, equal to 64 mm. The protuberance 150 has a height, measured in the transverse direction Y. The height of the protuberance is, for example, equal to 0.5 mm.

The protuberance 150 forms with the control mechanism 25, a mechanical link of "spot link" type. In effect, the second diameter D2 of the protuberance 150 is very much smaller than the dimensions of the auxiliary module. In particular, the contact surface area between the shroud 60 and the protuberance 150 is less than a fiftieth of the surface area of the first lateral face 115A. The mechanical link between the protuberance 150 and the control mechanism 25 therefore eliminates a single degree of freedom between the control mechanism 25 and the auxiliary module 35. The mechanical link between the protuberance 150 and the control mechanism 25 therefore allows five degrees of freedom between the control mechanism 25 and the auxiliary module 35.

Each elastic branch 155 is integrally formed with the enclosure 70. The elastic branches 155 delimit a first opening for introduction of the mechanical referencing member 30 into the first reception cavity 160. The first opening has a first internal width Li1 defined as being the minimum distance between two points of the elastic branches 155. The first internal width Li1 is strictly less than the first diameter D1 of the mechanical referencing member 30.

The maximum distance, measured in the transverse direction Y, between two points of the elastic branches 155 is equal to 15 mm. The elastic branches 155 therefore prevent the auxiliary module 35 from pivoting, relative to the mechanical referencing member 30, about the vertical direction Z and about the longitudinal direction X, but allow the rotation about the transverse direction Y.

The elastic branches 155 are configured to be elastically deformed in order to allow the introduction of the mechanical referencing member 30, through the first introduction opening, into the first reception cavity 160.

The first reception cavity 160 is cylindrical with circular base about a second axis A2. When the auxiliary module 35 is disposed in the casing 15, the second axis A2 is merged with the first axis A1. The second axis A2 is therefore parallel to the transverse direction Y.

The first reception cavity 160 has a first internal diameter D3 greater than or equal to the first diameter D1 of the mechanical referencing member 30.

The second reception cavity 165 is cylindrical about a third axis A3. The third axis A3 is parallel to the transverse direction Y. The second reception cavity 165 has a flat surface 182 opposite the second introduction opening 150 in the vertical direction Z.

The second reception cavity 165 has a second internal diameter D4 greater than or equal to the diameter of the head of the tenon 145. The second reception cavity 165 is configured so that, when the head 145 is received in the second reception cavity 165, the head 145 is bearing on the flat surface 182 of the second reception cavity 165.

The second opening 170 has a minimum distance between two points of the elastic arms 140 which is strictly less than the diameter of the head 180 of the tenon 145. This minimum distance between two points of the elastic arms 140 is measured in the longitudinal direction X.

The base 175 is parallelepipedal. The base 175 has a width, measured in a plane at right angles to the vertical direction Z, strictly less than the minimum distance between two points of the elastic arms 140. The head 180 has a diameter strictly greater than the width Lb of the base 175.

Thus, the switching apparatus 10 allows an accurate positioning of each auxiliary module 35 in relation to the control mechanism 25 through the mechanical referencing member common to the control mechanism 25 and to each auxiliary module 35.

Furthermore, the switching apparatus 10 allows, through its architecture, an accurate positioning of each switching member 20A, 20B, 20C in relation to the control mechanism 25. In effect, the mechanical referencing member 30 is, furthermore, common to each switching member 20A, 20B, 20C.

Furthermore, the direct mechanical couplings of the auxiliary module 35 with the spacer 45 and the control mechanism 25 allow for easy placement of the auxiliary module 35 in the casing 15, involving few parts. The number of mechanical links between the auxiliary module 35 and the control mechanism 25 is therefore reduced. The actuation of the control mechanism 25 by the auxiliary module 35 is therefore more reliable.

Through the formation, between the auxiliary module 35 and the other members of the switching apparatus 10 and the casing 15, of three mechanical links eliminating, respectively, four degrees of freedom, one degree of freedom and one degree of freedom, the assembly of the auxiliary module 35 is isostatic. The dimensional dispersion between the auxiliary module 35 and the control mechanism 25 is therefore reduced. The actuation of the control mechanism 25 by the auxiliary module 35 is, likewise, more reliable.

Another exemplary embodiment of the auxiliary module 35 is represented in FIG. 5. The elements identical to those of the first exemplary embodiment of the auxiliary module of FIGS. 2 to 4 are not described again. Only the differences are highlighted.

The auxiliary module 35 is a trip controlled following the detection of an electrical fault of the first current or following a command that is deliberate and suitable for actuating the control mechanism 25 in case of detection of the electrical fault or of the deliberate command.

The auxiliary module 35 does not comprise any second guiding member 85B.

The auxiliary module 35 comprises at least one elastic retaining protuberance 185. In FIG. 5, the auxiliary module 35 comprises two elastic retaining protuberances 185.

Each elastic retaining protuberance 185 is configured to prevent the removal of the auxiliary module 35 from the casing 15. Each elastic retaining protuberance 185 is suitable for collaborating with a cavity of the casing 15 by snap-fitting.

Each elastic retaining protuberance 185 is borne by a lateral face 115A, 115B of the enclosure 70. Each elastic retaining protuberance 185 is integrally formed with the enclosure 70. Each elastic retaining protuberance 185 has a cam surface 190 and an abutment surface 195.

The cam surface 190 is inclined relative to the vertical direction Z, and oriented towards the bottom of the casing 15. The cam surface 190 is suitable for cooperating with the casing 15 to bring about, upon the introduction of the auxiliary module 35 into the casing 15, the deformation of the lateral face 115A, 115B towards the interior of the enclosure 70.

The abutment surface 195 is at right angles to the vertical direction Z and oriented towards the cover 40. The abutment surface 195 is configured to come into abutment against a blocking surface, not represented, of the casing 15 when a force directed in the vertical direction Z is exerted, by an operator, to extract the auxiliary module 35 from the casing 15.

The auxiliary module 35 cannot be removed manually from the casing 15 by an operator. The switching apparatus 10 is then safer. That is particularly important in the case of trips suitable for detecting an electrical fault, which are designed to be disposed in a factory in the casing 15 and to remain in place throughout the life of the switching apparatus 10.

The invention claimed is:

1. An electrical switching apparatus comprising:

a protection casing;

a plurality of switching members disposed in the casing aligned in a transverse direction of the switching apparatus and each comprising an input connection lug and an output connection lug, each switching member being suitable for switching between a first position permitting the passage of the current between the input connection lug and the output connection lug and a second position preventing the passage of the current between the input connection lug and the output connection lug;

a control mechanism for control of each switching member between its first and second positions;

at least one auxiliary module disposed in the casing, the auxiliary module being configured to implement an electrical or mechanical function associated with the control mechanism, wherein a mechanical referencing member common to the control mechanism and to each auxiliary module, for the positioning of the control mechanism and of each auxiliary module in the casing; and at least one spacer separating two respective switching members in the transverse direction, the auxiliary module being mechanically coupled to the at least one spacer.

2. The switching apparatus according to claim 1, in which the auxiliary module and the mechanical referencing member are mechanically linked by a mechanical link eliminating four degrees of freedom between the auxiliary module and the mechanical referencing member.

3. The switching apparatus according to claim 1, in which the switching apparatus comprises a plurality of spacers.

4. The switching apparatus according to claim 1, in which the auxiliary module and the spacer are mechanically linked by a mechanical link eliminating a degree of freedom between the auxiliary module and the spacer.

5. The switching apparatus according to claim 1, in which the switching apparatus further comprises a guiding member configured to guide the auxiliary module relative to the casing upon the insertion of the auxiliary module into the casing or upon the extraction of the auxiliary modules from the casing.

6. The switching apparatus according to claim 1, in which the switching apparatus comprises a plurality of auxiliary modules, each auxiliary module being disposed in the casing, the mechanical referencing member being common to the control mechanism and to each auxiliary module for the positioning of the control mechanism and of the auxiliary modules in the casing.

7. The switching apparatus according to claim 1, in which the auxiliary module comprises an elastic retaining protuberance configured to prevent a manual removal of the auxiliary module from the casing.

8. The switching apparatus according to claim 1, in which the mechanical referencing member is common to each auxiliary module, to the control mechanism and to each switching member.

9. The switching apparatus according to claim 1, in which the auxiliary module is a trip configured to actuate the control mechanism for the switching of the switching member.

10. The switching apparatus according to claim 1, in which the switching apparatus is a circuit breaker.

11. The switching apparatus according to claim 1, in which the auxiliary module is directly mechanically coupled to the control mechanism.

12. The switching apparatus according to claim 11, in which the auxiliary module and the control mechanism are mechanically linked by a mechanical link eliminating a degree of freedom between the auxiliary module and the control mechanism.

* * * * *